United States Patent [19]

Ishioka et al.

[11] 4,024,896

[45] May 24, 1977

[54] WASHING DEVICE FOR ROTARY FILLING MACHINE

[75] Inventors: Yoshiji Ishioka, Kanazawa; Jyuro Kawamura, Uchinada, both of Japan

[73] Assignee: Shibuya Kogyo Company, Ltd., Kanazawa, Japan

[22] Filed: Nov. 26, 1975

[21] Appl. No.: 635,643

[30] Foreign Application Priority Data

| | | |
|---|---|---|
| May 13, 1975 | Japan | 50-56318 |
| May 27, 1975 | Japan | 50-63222 |
| June 10, 1975 | Japan | 50-69882 |

[52] U.S. Cl. ..... 141/90; 141/91; 222/149

[51] Int. Cl.[2] ..... B65B 3/04

[58] Field of Search ..... 134/166 R, 166 C, 167 R, 134/167 C; 137/237–239; 141/85, 89–91, 392; 222/148, 149

[56] References Cited

UNITED STATES PATENTS

| | | | |
|---|---|---|---|
| 2,132,424 | 10/1938 | Le Frank | 141/91 |
| 2,656,966 | 10/1953 | McDonough et al. | 141/91 X |

*Primary Examiner*—Richard E. Aegerter
*Assistant Examiner*—Frederick R. Schmidt
*Attorney, Agent, or Firm*—Woodhams, Blanchard and Flynn

[57] ABSTRACT

A washing device for a rotary filling machine which device is provided with the same number of washing liquid pipes as the number of filling nozzles. During the usual filling step, the washing liquid pipes are positioned so as not to interrupt the movement of the bottles to be filled. During the washing step, the washing liquid pipes are positioned directly below the filling nozzles. The washing liquid pipes are then brought close to and pressed against said filling nozzles, the valves mounted in said filling nozzles are pushed open by the tip ends of said washing liquid pipes, and thereby the flow passages for the filling liquid including the inner parts of said filling nozzles are washed with a washing liquid.

24 Claims, 17 Drawing Figures

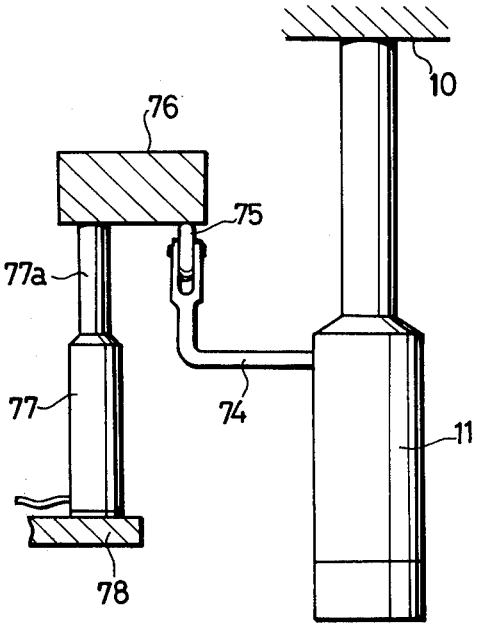
FIG.12
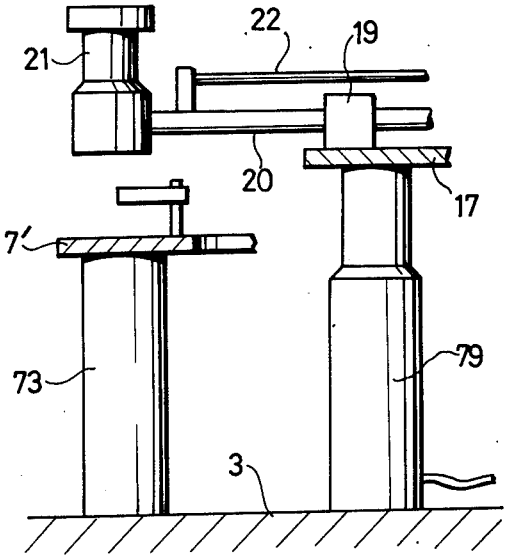

WASHING DEVICE FOR ROTARY FILLING MACHINE

BACKGROUND OF THE INVENTION

1. Field of the Invention

This invention relates to a washing device for a rotary filling machine. More particularly, the invention relates to a washing device mounted on a rotary filling machine, which device comprises the same number of washing liquid pipes as the number of filling nozzles, a driving mechanism and a vertically moving mechanism to actuate said washing liquid pipes, and is characterized in that, during the filling step, said washing liquid pipes are moved to positions in which they do interrupt the movement of the bottles to be filled, and during the washing step, said washing liquid pipes are caused to engage with said filling nozzles. Thus the washing of the liquid flow passages can be easily and effectively carried out.

2. Description of the Prior Art

In the conventional method for washing the insides of filling nozzles, liquid tanks and so forth of a rotary filling machine, the liquid tank is filled with washing liquid and the washing liquid is flowed into bottles from the filling nozzles just like the usual filling operation, or the washing liquid pipes of a separately provided washing machine are pressed against the open ends of the filling nozzles so as to force open the valves within the filling nozzles and the washing liquid is supplied in the reverse flow direction to the flow direction of the filling liquid.

In the former method, however, there are several disadvantages, namely, that the air discharge pipes attached in the filling nozzles can not be washed, the bottles for receiving the washing liquid have to be prepared, and in addition, the washing liquid must be discharged from the bottles. In the latter method, after fitting the end portions of the washing liquid pipes to the openings of the filling nozzles, the washing liquid pipes must be raised in order to force open the valves of the filling nozzles. This method takes a large amount of labour and time since the positioning of the washing liquid pipes takes much time and in addition, the operation must be repeated so as to wash all of the filling nozzles.

SUMMARY OF THE INVENTION

Therefore the primary object of the present invention is to provide a washing device for a rotary filling machine in which the filling machine is provided with an equal number of washing liquid pipes as the number of the liquid filling nozzles. During the usual filling step, the washing liquid pipes are positioned so as not to interrupt the movement of the bottles as they are filled with filling liquid. In the washing step, the washing liquid pipes are moved under the filling nozzles, both are then brought close to and pressed against one another so as to force open the valves within said filling nozzles with the tip ends of said washing liquid pipes, and thereby the filling liquid passages through all of the filling nozzles and other portions can be simultaneously washed. With the employment of this device, the above-mentioned troubles such as the preparation of bottles, discharging of the washing liquid from the bottles and fitting of washing liquid pipes to the filling nozzles can be eliminated. Therefore the washing of the filling machine can be easily carried out within a very short time.

The next object of the present invention is to provide various means for bringing the washing liquid pipes close to and pressing them against all of the filling nozzles according to the types of the conventionally known rotary filling machines. That is, in one type of rotary filling machine there are circularly disposed around the axis of rotation of a rotating member a plurality of bottle conveyor tables which vertically move the bottles during the transfer of the bottles. Filling nozzles located on the same level and opposed to the conveyor tables are attached to the underside of the liquid tank which rotates together with the conveyor tables and the rotating member. The bottles are brought close to filling nozzles by raising the conveyor tables carrying the bottles. The valves mounted in said filling nozzles are opened by the upper open ends of said bottles and thereby the bottles are filled with liquid. Since the heights of said filling nozzles are all the same, if the positions of the washing liquid pipes are on the even level when they are moved just below the filling nozzles, both the filling nozzles and the washing liquid pipes can be brought into contact with one another by lowering the liquid tank together with the filling nozzles or by raising the supporting members carrying said washing liquid pipes.

There is another type of filling machine which is provided with bottle conveyor tables for carrying the bottles around the axis of rotation and on the same horizontal plane and vertically movable filling nozzles which rotate together with said conveyor tables and are disposed above said conveyor tables in opposition to the bottles carried by said conveyor tables. In this filling machine, the end portions of the filling nozzles are pressed against the upper open ends of said bottles by lowering said nozzles and thereby the valves of said nozzles are opened by the upper ends of said bottles so as to fill the bottles with liquid. In this case, the positions of said filling nozzles are not even, so that in order to press the filling nozzles and the washing liquid pipes together, the filling nozzles are aligned on the same horizontal level to bring the washing liquid pipes of the same height close to said filling nozzles, or the washing liquid pipes are vertically moved in compliance with the uneven positions of said filling nozzles and they are brought close to one another as they stand.

A further object of the present invention is to provide various driving mechanisms to move said washing liquid pipes to the positions just below said filling nozzles, respectively.

BRIEF DESCRIPTION OF THE DRAWINGS

These and other objects and features of the invention will become more apparent from the following description taken in connection with the accompanying drawings in which:

FIG. 12 is a vertical sectional view of the main portion of a modification of said second embodiment;

DESCRIPTION OF THE PREFERRED EMBODIMENTS

Referring now to the accompanying drawings, the preferred embodiments of the present invention will be described. FIGS. 1 to 5, inclusive, show the first embodiment of the present invention, in which a rotary filling machine having a plurality of filling nozzles aligned on a horizontal plane is provided with the same number of washing liquid pipes also aligned on another horizontal plane.

That is, in the first embodiment, each filling nozzle is not vertically moved relatively to the other filling nozzles and the vertical position of each washing liquid pipe is not varied either, relative to the other washing liquid pipes.

Figure 1:
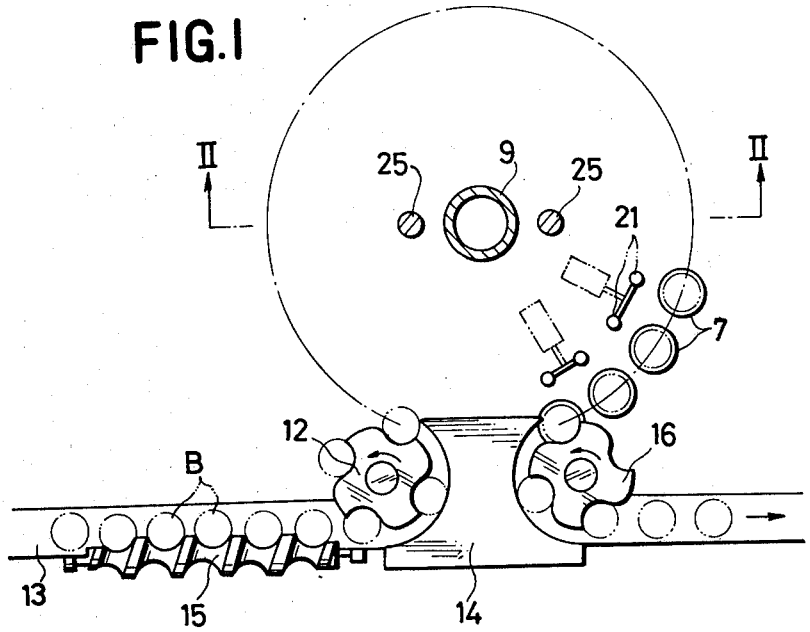
FIG. 1 is a schematic plan view of the main portion of a rotary filling machine of the first embodiment.
Figure 2:
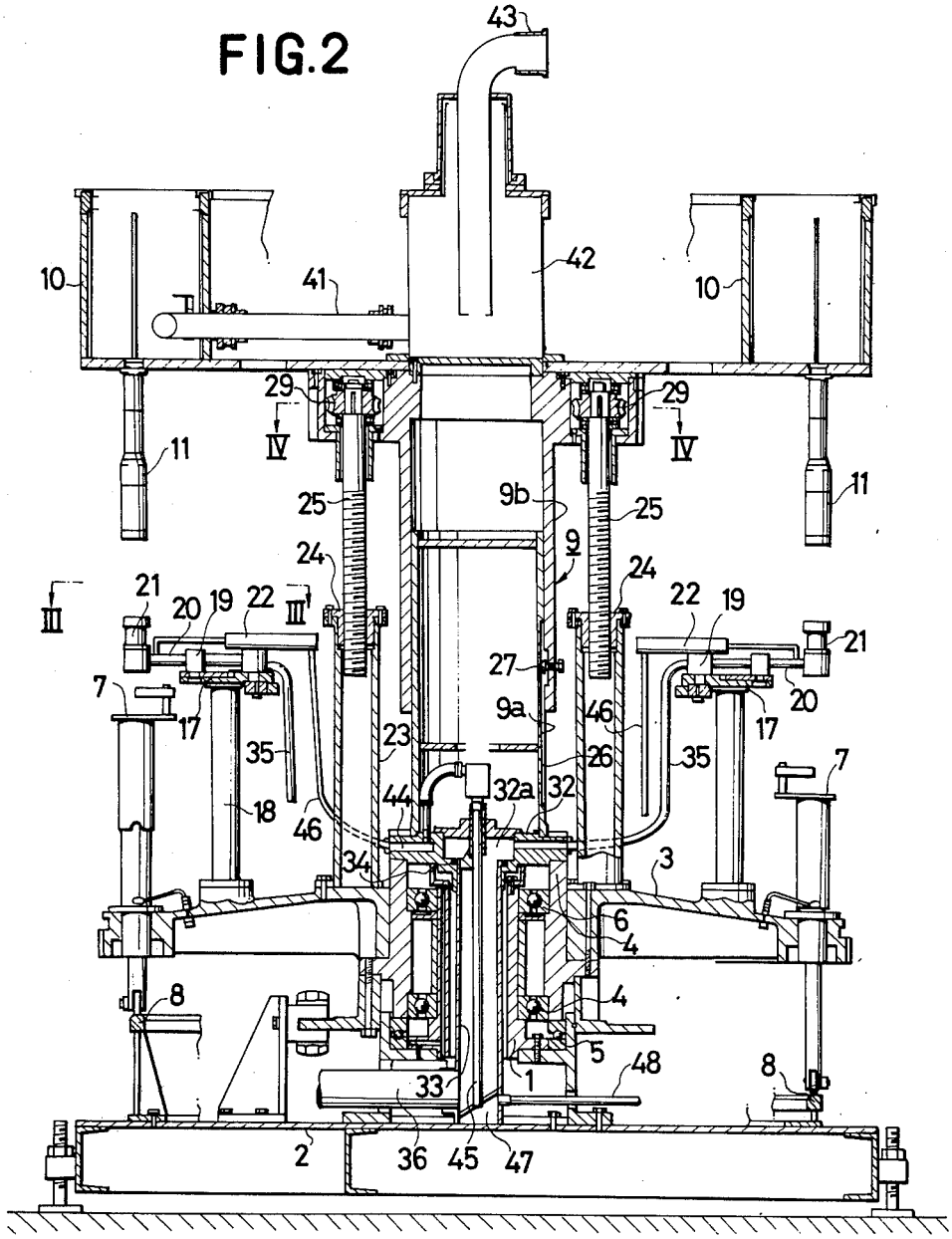
FIG. 2 is a vertical sectional view taken along the line II—II in FIG. 1.

In FIG. 2, a fixed shaft 1 is attached to the center of a base plate 2 of the filling machine and a disk 3 is fixed to the cylinder 6 which is rotatably mounted on the fixed shaft 1 by means of bearings 4 and 5. A plurality of bottle conveyor tables 7 are disposed around this disk 3 at regular intervals and, by means of the cam 8 attached above the base plate 2 and concentric with the fixed shaft 1, the tables 7 are vertically moved relatively to the disk 3 during their rotation together with the disk 3. Attached at the top end of said cylinder 6 is a rotating shaft 9 having an axis coinciding with that of said cylinder 6. A tank 10 for the liquid to be filled into bottles (hereinafter referred to as "filling liquid") is attached to the upper end of the rotating shaft 9 and filling nozzles 11 opposed to the upper surfaces of the respective conveyor tables 7 are attached to the under surface of the tank 10. Thus the respective conveyor tables 7 and the filling nozzles 11 revolve around the axis of the above-mentioned shaft 9 in face to face relation. Further in FIG. 1, the bottles B transferred by a conveyor 13 are passed to said conveyor tables 7 along the guide member 14 by means of a star wheel 12, wherein the bottles B on the conveyor 13 are moved to said star wheel 12 at regular intervals by a timing screw 15. On the other side of the guide member 14, another star wheel 16 is provided which takes out the bottles B from the conveyor tables 7 onto the conveyor 13 along the guide member 14.

The conventional rotary filling machine provided with filling nozzles 11 on the same horizontal plane generally has the above-disclosed structure and the bottles B passed from the star wheel 12 to the conveyor tables 7 are moved around the axis of the rotating shaft 9 by said tables 7. When the conveyor table 7 is raised by the above-mentioned cam 8, the bottle B on the table 7 is moved up and the upper opening of the bottle engages with the opposed filling nozzle 11, thus the valve (not shown) provided inside the nozzle 11 is pushed open. Then the filling liquid in the above-mentioned tank 10 flows into the bottle B through the filling nozzle 11, and when the bottle B is filled up with the liquid, the conveyor table 7 is lowered by said cam 8 and the valve of the filling nozzle 11 is closed. The bottle B filled with the filling liquid is taken out from the conveyor table 7 to the conveyor 13 by said star wheel 16, thus the filling of the liquid into the bottle B is completed.

Figure 3:
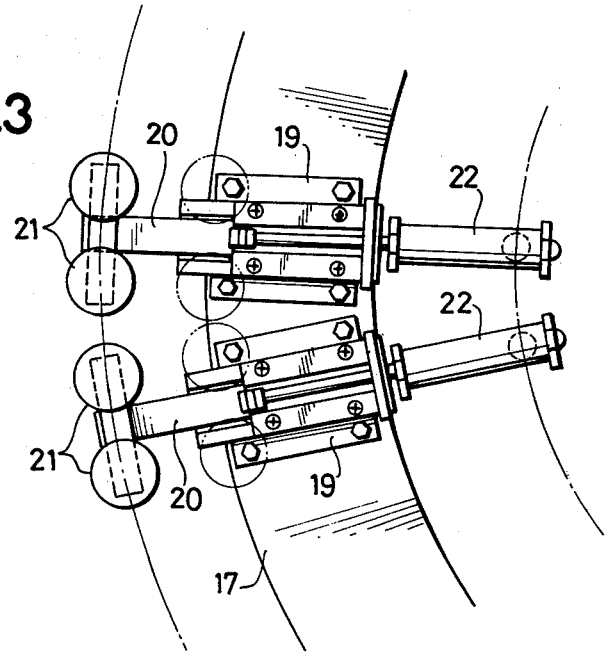
FIG. 3 is a plan view taken along the line III—III in FIG. 2.

Still in the present invention, the rotary filling machine is provided with a washing device which will be explained in detail in the following. In FIG. 2, a supporting ring 17 is held by supporting posts 18 fixed to said disk 3 and the ring 17 rotates with the disk 3. A plurality of brackets 19 are attached to said supporting ring 17 at regular intervals and slide pipes 20 are fitted to said brackets 19 so as to slide in the radial direction relative to the disk 3. As shown in FIG. 3, each of said slide pipes 20 is provided with two washing liquid pipes 21 at its outer end and the pipes 21 are directed upward. The slide pipe 20 is connected to a cylinder device 22, and by this device 22, the washing liquid pipe 21 is moved inwardly out of the way of the bottles B during the filling step, while in the washing step, all washing liquid nozzles 21 are moved outwardly by the cylinder devices 22 to the positions directly below the respective filling nozzles 11.

Further, supporting posts 23 are vertically fixed to said disk 3 on both sides of the rotating shaft 9 and attached to the top ends of said supporting posts 23 are female screws 24. Engaged with the female screws 24 are two vertical screws 25 which are rotatably supported on both sides of the rotating shaft 9. By rotating these vertical screws 25, the above-mentioned tank 10 and the filling nozzles 11 attached under the tank are moved vertically. So as to facilitate the vertical movement of the rotating shaft 9, the shaft 9 is formed of two slidably fitted cylinders 9*a* and 9*b* and both the cylinders 9*a* and 9*b* are made to rotate together by providing a key way 26 in the axial direction on the cylinder 9*a* and a key 27 on the cylinder 9*b*.

Figure 4:
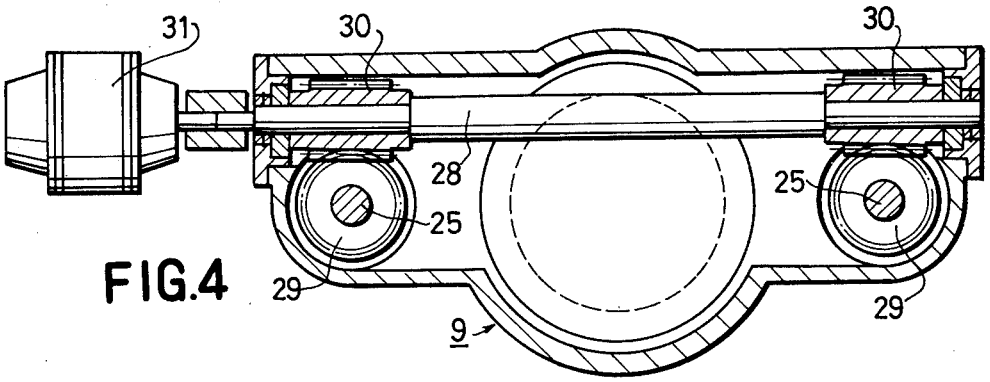
FIG. 4 is a horizontal sectional view taken along the line IV—IV in FIG. 2.

Further in FIG. 4, a driving shaft 28 is rotatably supported by the rotating shaft 9 and the worms 30 fixed to this driving shaft 28 are engaged with the worm wheels 29 attached at the upper ends of the above-mentioned vertical screws 25. One end portion of said driving shaft 28 is connected to a motor 31 which is attached to said rotating shaft 9 and, by this motor 31, the vertical screws 25 are rotated through the driving shaft 28, worms 30 and worm wheels 29. Thus the above-mentioned tank 10 and filling nozzles 11 are vertically moved.

Accordingly, after the shifting of the washing liquid pipes 21 directly below the filling nozzles 11, the tank 10 is lowered to push the filling nozzles 11 against the washing liquid pipes 21. Thus the valves within the tip portions of the filling nozzles 11 are forced open by the tip ends of the washing liquid pipes 21 and when a washing liquid is supplied from the washing liquid pipes 21, each filling nozzle 11 and other parts can be washed.

Figure 5:
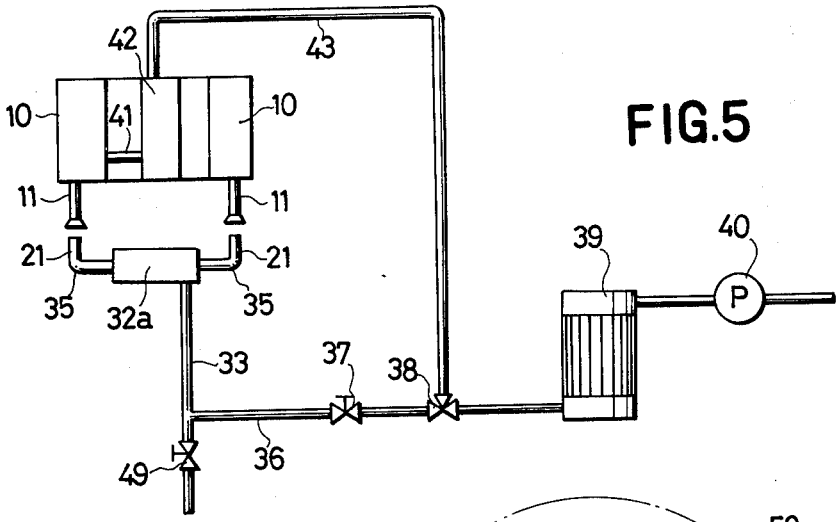
FIG. 5 is a piping drawing.

Further as shown in FIG. 2, a rotary disk 32 is attached between the rotating shaft 9 and the cylinder 6 and a sealed chamber 32*a* is formed within said rotary disk 32. Further a vertical pipe 33 is fitted into the foregoing fixed shaft 1 and this pipe 33 and said sealed chamber 32*a* are communicated by using a sealing member 34. Thus the rotary disk 32 can be rotated relative to the vertical pipe 33 owing to the provision of this sealing member 34. The sealed chamber 32*a* and washing liquid pipes 21 are connected by means of the slide pipes 20 and the tubes 35 which are radially disposed between said rotary disk 32 and the inner ends of the slide pipes 20. As shown in FIG. 5, the pipe 36 attached to said vertical pipe 33 is connected to a pump 40 through a stop valve 37, a change-over valve 38 and a sterilizing apparatus 39. Furthermore, the above-described tank 10 is also connected to the pump 40 by way of a pipe 41, a chamber 42, another pipe 43 and said change-over valve 38.

Still further in FIG. 2, the inner passage 44 communicates with the tube 45 disposed on the axis of the vertical pipe 33, and the flexible tube 46 communicates with both the inner passage 44 and the cylinder device 22. The cylinder device 22 is connected to an air source through these passages, the chamber 47 formed under the vertical pipe 33 and the pipe 48 connected to said chamber 47. Thus the control of the movement of the slide pipe 20 in the inner and outer directions can be carried out. Incidentally, the numeral 49 in FIG. 5 is a drain valve.

In the usual state, the washing liquid pipes 21 are moved backward by actuating the cylinder devices 22 so as to position the washing liquid pipes 21 radially inwardly of the filling nozzles 11. Thus movement of the bottles B carried by the conveyor tables 7 is not interrupted by the washing liquid pipes 21 and the usual filling operation of the filling machine can be performed. In the filling operation, the upstream side of said pump 40 is connected to a storage tank (not shown) of the filling liquid and the change-over valve 38 is connected to the line 43 so as to deliver the filling liquid into the tank 10 through the sterilizing apparatus 39 and pipe 43 by means of the pump 40.

In the washing step of the above-mentioned rotary filling machine, the washing liquid pipes 21 are aligned just under the filling nozzles 11 by actuating the cylinder device 22 and the tank 10 is lowered by rotating the vertical screws 25 with using the motor 31. Thus the filling nozzles 11 attached to the tank are lowered and brought into contact with the washing liquid pipes 21, further the tips of pipes 21 force open the valves within the filling nozzles. In this state, the pump 40 is connected to the tank of washing liquid (not shown) on the upstream side, the change-over valve 38 is connected to the side of pipe 36, the valve 37 is opened and the drain valve 49 is closed. When the pump 40 is then operated, the washing liquid is passed through the sterilizing apparatus 39, change-over valve 38, stop valve 37, pipe 36, vertical pipe 33 and into the chamber 32*a* of the rotary disk 32. The washing liquid is further passed to the tank 10 through the tube 35, slide pipe 20, each washing liquid pipe 21 and filling nozzle 11. After the washing of the passage of each part, the pump 40 is stopped and the drain valve 49 is opened to discharge the washing liquid from the tank 10 through the drain valve 49. Thereby the washing is finished.

Further, the washing is also performed by changing the change-over valve 38 to the line 43 and passing the washing liquid from the tank 10 to the filling nozzles 11, or both the above two directions may be employed in combination, or one of them may be used as the rinsing step.

The mechanisms employed in the above embodiment are the driving mechanism to move the washing liquid pipes 21 in the radial directions of the rotary filling machine by cylinder devices 22 and to align said pipes 21 just below the filling nozzles 11 and the vertical movement mechanism to lower the filling nozzles 11 and to push the nozzles 11 against the washing liquid nozzles 21 so as to force open the valves mounted within the filling nozzles 11.

In a modification of the above, the employed mechanisms are a driving mechanism to move the washing liquid pipes 21 in the rotational direction of the rotary filling machine and a vertical movement mechanism to raise the washing liquid pipes 21.

Figure 6:
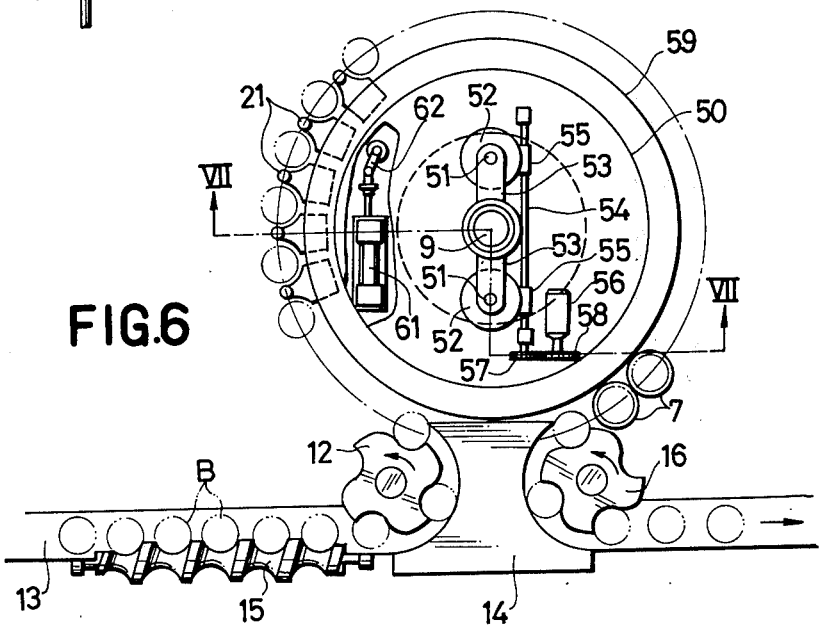
FIG. 6 is a schematic plan view of a modification of the above-mentioned first embodiment.
Figure 7:
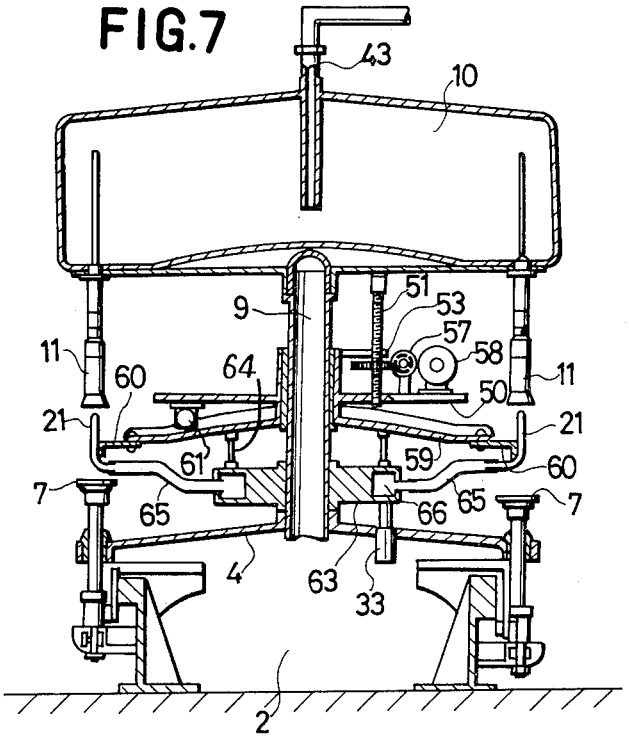
FIG. 7 is a vertical sectional view taken along the line VII—VII in FIG. 6.

In FIGS. 6 and 7, the same or corresponding parts are indicated with the same numerals, respectively. A supporting plate 50 is attached vertically movably to the main shaft 9 which corresponds to the rotating shaft of the foregoing embodiment. Two screw shafts 51 (see FIG. 6) are vertically mounted on the lower surface of the bottom of tank 10 and worm wheels 52 are engaged with the respective screw shafts 51. The worm wheels 52 are rotatably held by the arm members 53 horizontally extending from the upper end portion of said supporting plate 50 and engaged with the worms 55 fixed to a shaft 54 which is rotatably supported on the supporting plate 50. Further, the worm wheels 52 are thus interconnected with the motor 56 by way of said worms 55 and a pair of engaging gears 57 and 58, the former gear 57 being attached to the end of said shaft 54 and the latter gear 58 being fixed to the shaft of said motor 56. Therefore, when the motor 56 is driven, the worm wheels 52 are rotated and vertically moved relatively to the screw shafts 51, and accordingly, the supporting plate 50 carrying these worm wheels with the arm members 53 is also vertically moved along the main shaft 9.

Further, provided under said supporting plate 50 is a circular frame plate 59 which is rotatable in relative to said supporting plate 50. Around this frame plate 59, the same number of supporting members 60 as that of the above-mentioned filling nozzles 11 are attached at the same distances apart as the filling nozzles 11, and washing liquid pipes 21 are further fixed to said supporting members 60 with the tip ends facing upward. The under side of said supporting plate 50 is provided with a cylinder device 61 which is connected to said frame plate 59 by means of a connecting member 62. When the cylinder device 61 is actuated, the frame plate 59 is moved circumferentially relatively to the supporting plate 50 by means of the connecting member 62, that is, the washing liquid pipes 21 can be shifted to the positions just below the respective filling nozzles 11 by turning the pipes 21 on the frame plate 59 relatively to the filling nozzles 11 on the side of supporting plate 50.

Further on the lower side of the frame plate 59, a cylindrical member 63 is attached to the main shaft 9 in such a manner that said cylindrical member 63 is vertically moved in relation to the shaft 9. The frame plate 59 is connected with this cylindrical member 63 by means of rods 64 and flexible tubes 65 connect the hollows 66 formed on the periphery of the cylindrical member 63 with said washing liquid pipes 21. In like manner as the foregoing embodiment, said hollows 66 are connected to the pump 40 by way of pipes 33 and 36, a valve 37, a change-over valve 38 and a sterilizing apparatus 39, and the upper portion of the tank 10 is connected to the change-over valve 38 with a tube 43, thus the tank 10 is also connected to the pump 40 (see FIG. 5).

In this modified embodiment, the cylinder device 61 is actuated to cause the washing liquid pipes 21 to deviate from the positions of filling nozzles 11 and as shown in FIG. 6, each washing liquid pipe 21 is positioned between adjacent filling nozzles 11. Therefore, the bottles B carried by the conveyor tables 7 are not interrupted with the washing liquid pipes 21 as they move round together, and the filling operation of the rotary filling machine can be performed in like manner as the foregoing embodiment.

While in the washing step of the rotary filling machine, the cylinder device 61 is actuated to move the washing liquid pipes 21 to the positions just below the respective filling nozzles 11 and thereafter the supporting plate 50 is raised by the motor 56. Thus the frame plate 59 connected to this supporting plate 50 and the cylindrical member 63 connected to the frame plate 59 with the rods 64 are also raised and the washing liquid pipes 21 attached to the frame plate 59, thereby the valves in the filling nozzles 11 are pushed open by the tip ends of the washing liquid pipes 21. Therefore in like manner as the above-disclosed embodiment, the parts of the machine such as the tank 10 and the filling nozzle 11 can be washed.

Further, another modification of the drawing mechanism to move the washing liquid pipes 21 from the deviated positions to the positions just below the filling nozzles 11 is illustrated with reference to FIGS. 8 and 9.

Figure 8:
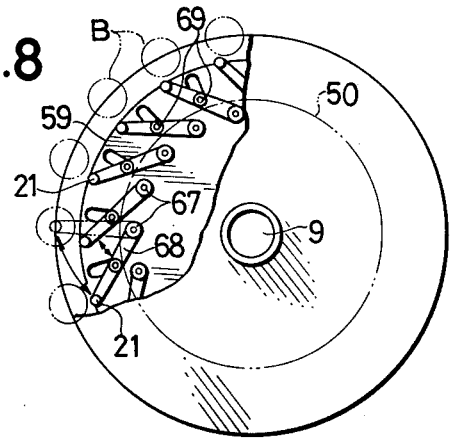
FIG. 8 and FIG. 9 are schematic plan views of other modifications of the driving mechanisms for washing liquid pipes.

In the mechanism shown in FIG. 8, the root portions of arms 68 are pivoted with shafts 67 attached to the supporting plate 50 and a rotatable cam follower 69 is attached to the middle portion of each arm 68. Each cam follower 69 is caused to engage with the radial cam groove formed on the frame plate 59 and the tip end of each arm 68 is provided with the washing liquid nozzle 21. When the relative positions of the supporting plate 50 and the frame plate 59 are varied with respect to each other by the cylinder device 61 as disclosed in the above, the arms 68 are rocked thus the the washing liquid pipes 21 at the tip ends of the arms can be moved to the positions just below the filling nozzles 11.

Figure 9:
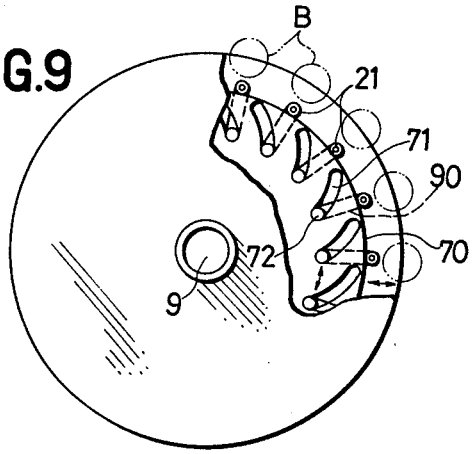

In the mechanism shown in FIG. 9, sliding members 90 having the washing liquid pipes 21 at their tip ends are slidably fitted to the upper surface of the frame plate 59 where the sliding members 90 are aligned in the radial directions, and provided between the frame plate 59 and the supporting plate 50 is a rotatable disk 70. On the periphery of this disk 70, arcuate cam grooves 71 are formed. Further, the cam followers 72 attached to the root portions of said sliding members 90 are caused to engage with said cam grooves, respectively. Thus when the disk 70 is turned slightly relatively to the supporting plate 50, the sliding members 90 are moved back and forth, and thereby the washing liquid pipes 21 can be moved to the positions just below the filling nozzles 11.

Further, when the latter driving mechanism is used, it is necessary to connect the supporting plate 50 integrally with the frame plate 59. Furthermore, when the washing liquid pipes are fully retracted by any of the above mechanisms, the pipes do not, of course, interrupt the movement of the bottles B.

In the above-disclosed first embodiment and the modifications thereof, the bottles B are filled with a liquid by raising the conveyor tables 7 and opening the valves of the filling nozzles 11 with the bottles B on the tables 7. In the following embodiments, however, the conveyor tables 7 are not vertically moved while the filling nozzles are vertically moved so as to fill the bottles with liquid. In the filling machine of this type, since some of the filling nozzles are at the upper position and the other nozzles are at the lower and intermediate positions, the heights of the filling nozzles must be made even in order to bring the washing liquid pipes into contact with the respective filling nozzles, or the washing liquid pipes must be moved together with the filling nozzles.

Figure 10:
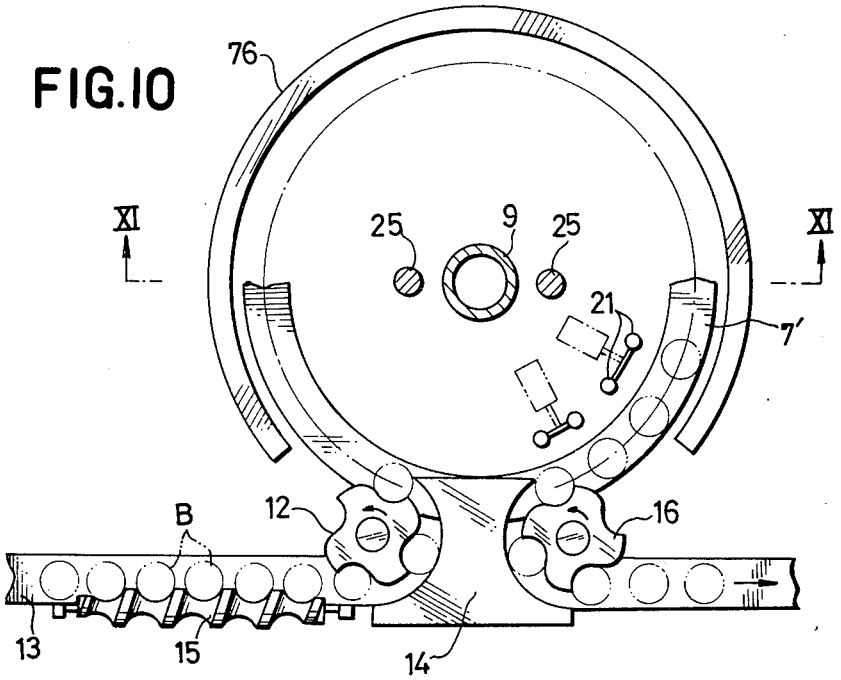
FIG. 10 is a schematic plan view of the second embodiment of the rotary filling machine.
Figure 11:
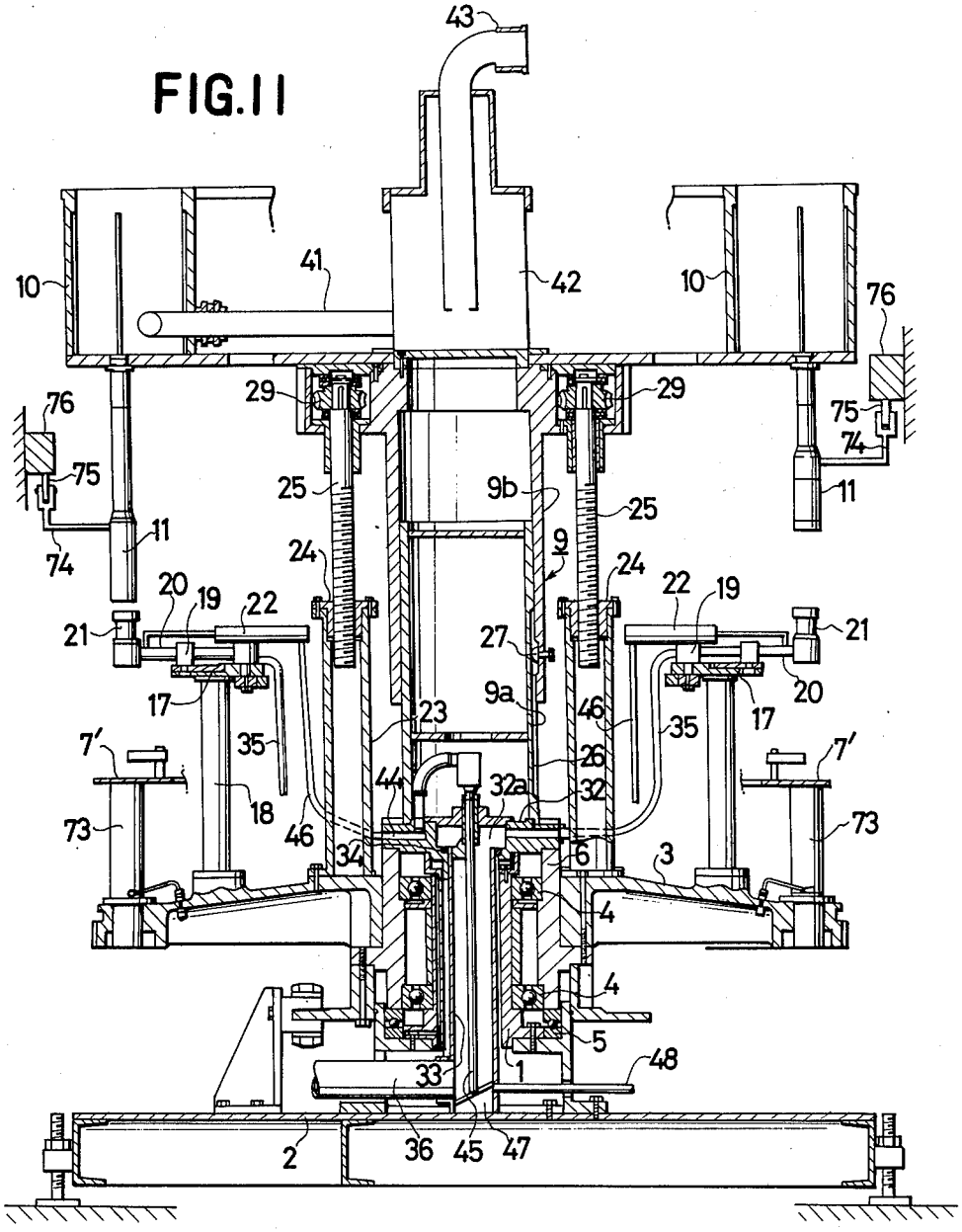
FIG. 11 is a vertical sectional view taken along the line XI—XI in FIG. 10.

The second embodiment as shown in FIGS. 10 and 11 is of the type in which the heights of filling nozzles are made even during the washing operation. In the filling operation, however, the filling nozzles are vertically moved relatively to other filling nozzles and the washing liquid pipes are not subjected to the relative movement in the vertical direction. The structure of this embodiment is almost the same as the first embodiment, thus the same or corresponding parts are indicated with the same reference numerals. The conveyor table 7' in this embodiment and the bottles B thereon do not need to be moved vertically which is different from the foregoing embodiment, thus the conveyor table 7' is in the form of a ring and the table 7' is fixed to the disk 3 with supporting legs 73. While, the filling nozzles 11 are vertically moved relatively to the tank 10. More particularly, each filling nozzle 11 is provided with an outwardly projecting arm 74 which is bent upward at its end portion, and a roller 75 is rotatably pivoted to the free end of said arm 74. Further, each filling nozzle 11 is urged upward by, for example, a spring (not shown). As shown in FIG. 10, on the lower outside of the tank 10, an arcuate cam 76 is disposed, and the rollers 75 of the arms 74 are brought into contact with the under surface of this cam 76. The height of the both ends of this cam 76 corresponds to the position of the roller 75 when the nozzle 11 is raised by the spring and the middle portion of the cam 76 is lowered so as to force down the filling nozzle 11 by means of the roller 75 and the arm 74 against the force of the spring. Accordingly, when the conveyor table 7' and the filling nozzles 11 are turned together, the roller 75 and the filling nozzle 11 connected thereto are lowered in the lowered portion of the cam 76 and, in the both end portions of the cam 76, the nozzle 11 is raised to the upper position by the force of spring.

When the filling machine of the second embodiment is used for filling liquid into bottles B, the washing liquid pipes 23 are retracted by actuating the cylinder device 22 so as to place the washing liquid pipes 21 on the inside portion of the filling nozzles 11, thus the bottles B carried on the conveyor table 7' are not interrupted by the washing liquid pipes 21 and therefore the bottles B passed on the conveyor table 7' by the star wheel 12 can be moved round the shaft 9 on the conveyor table 7' in which the bottles B are kept confronting the filling nozzles 11. When the roller 75 passes through the lowered portion of the cam 76 and the filling nozzle 11 is also caused to descend, the lower end of the filling nozzle 11 is pushed into contact with the upper opening of bottle B on the conveyor table 7' and the valve within the filling nozzle 11 is opened by the upper end of the bottle B. Thus the filling liquid in the tank 10 flows into the bottle B through the filling nozzle 11. When the bottle B is filled up with the liquid, the filling nozzle 11 is raised by the spring force and the valve therein is closed. The bottle B containing the filling liquid is then transferred from the conveyor table 7' to the conveyor 13 by the star wheel 16, thus the filling operation can be finished.

When the above-mentioned rotary filling machine is to be washed, the washing liquid pipes 21 are moved to the positions just below the respective filling nozzles 11 by the action of the cylinder devices 22 and then the vertical screws 25 are driven with the motor 31 to lower the tank 10.

With the descent of the tank 10, all of the filling nozzles 11 being pushed down by the cam 76 are moved back and thereby all the filling nozzles 11 are aligned on the same horizontal plane. When the tank 10 is further lowered, the filling nozzles 11 are pushed against the washing liquid pipes 21 with equal pressures. The valves within the filling nozzles 11 are thereby forced to open simultaneously by the tip ends of the washing liquid pipes 21. As disclosed in the above, when the washing liquid is fed in this state from the washing liquid pipes 21, the washing of the liquid passages of the filling nozzles and other parts can be performed.

In the modification of this second embodiment, the tank 10 is not lowered but the supporting ring 17 carrying the washing liquid pipes 21 is raised so as to open the valves in the filling nozzles 11 with the washing liquid pipes 21. In this case, since the end portions of the filling nozzles 11 are not on the same horizontal plane owing to the action of the above-mentioned cam 76, the positions of the filling nozzles 11 must be aligned.

That is, as shown in FIG. 12, a plurality of cylinder devices 77 are vertically placed on the supporting member 78 provided on the outside of the rotary filling machine and the above-mentioned cam 76 is attached to the top end of the cylinder rod 77*a* of each cylinder device 77. Thus the cam 76 is raised by extending the rods of the cylinder devices 77 and the filling nozzles 11 are also raised to the uppermost position with the spring forces. Therefore the ends of filling nozzles 11 can be aligned on the same level. The supporting ring 17 together with the washing liquid pipes 21 are then raised by supplying hydraulic pressure to the cylinder devices 79 which are provided in place of the above-mentioned supporting posts 18, and the end portions of the washing liquid pipes 21 are simultaneously pushed against the respective filling nozzles 11 to force open the valve in the nozzle 11.

Further, when the vertical movements of each filling nozzles 11 during the filling step are carried out by the respective cylinder devices attached to the filling nozzles 11 without using the cam 76, the filling nozzles 11 are also lowered by the same cylinder devices after the alignment of the washing liquid pipes 21 just below the filling nozzles 11 in the washing step, and thus the filling nozzles 21 are forced into contact with the respective washing liquid pipes 21.

The third embodiment of the present invention will be disclosed in the following in which the vertical movements of the washing liquid pipes 21 are caused to follow the movements of the filling nozzles 11. That is, the basic structure of this third embodiment is that the relative vertical movements are caused in both the filling nozzles and the washing liquid pipes. The filling machine of this embodiment has almost the same structure as the foregoing second embodiment, however, the third embodiment is different in that the washing liquid pipes 21 follow the vertical movements of the filling nozzles 11 and the uneven heights of the filling nozzles 11 are not made even during the washing.

Figure 13:
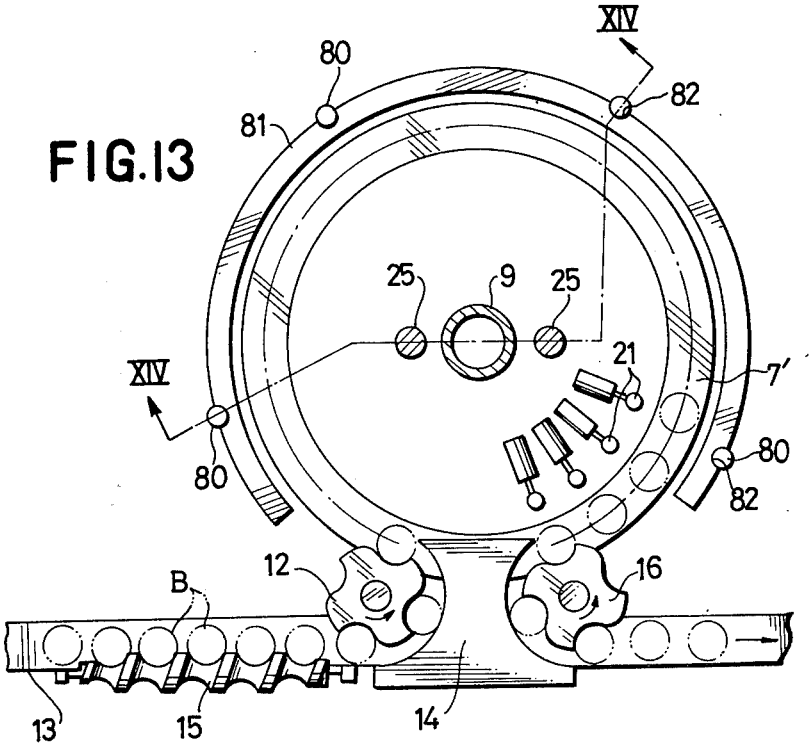
FIG. 13 is a schematic plan view of the third embodiment of the rotary filling machine.
Figure 14:
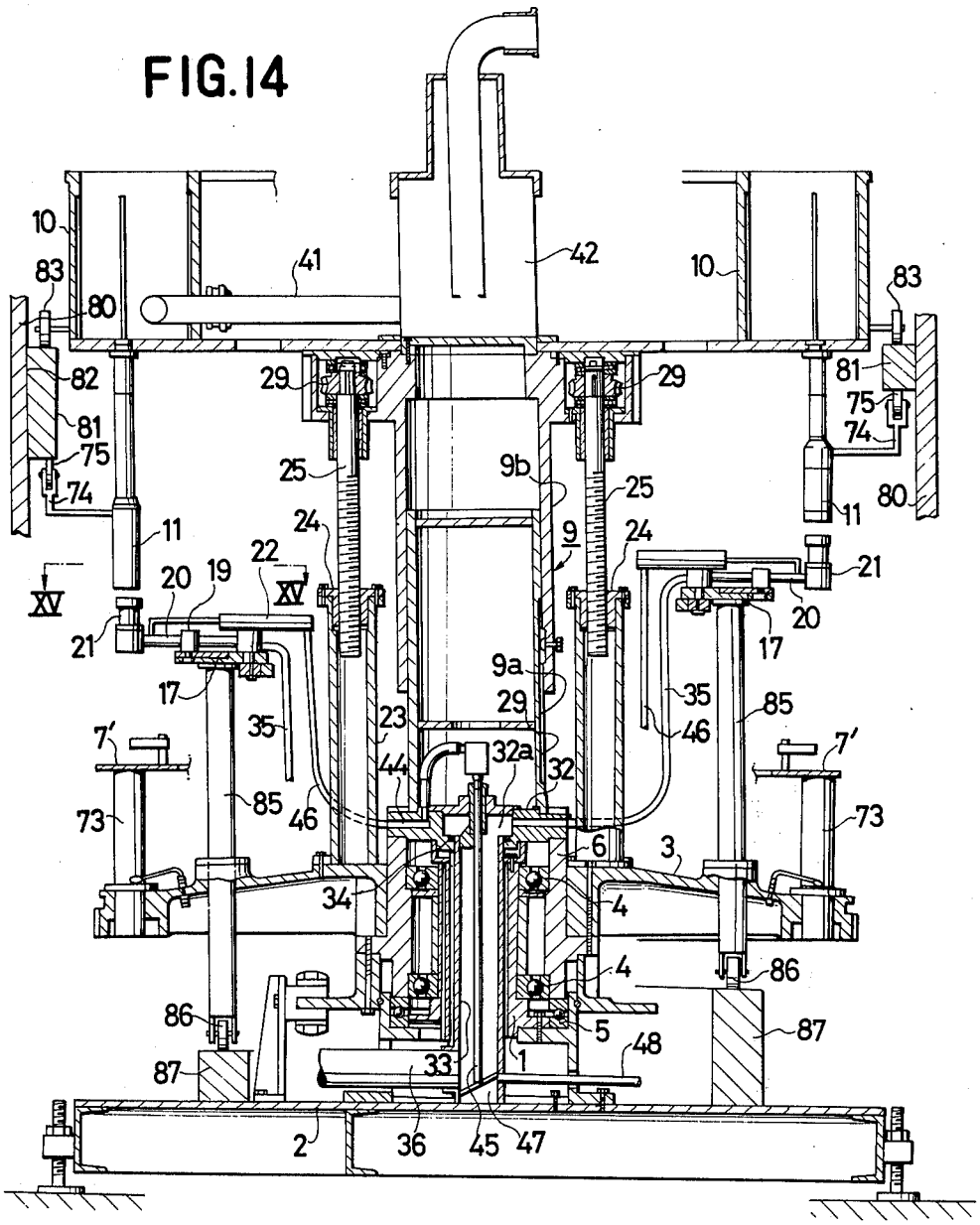
FIG. 14 is a vertical sectional view taken along the line XIV—XIV in FIG. 13.

As shown in FIGS. 13 and 14, a plurality of guide members 80 are vertically provided around the tank 10 and a cam 81 surrounding the filling nozzles 11 is vertically slidably attached to said guide members 80 where the fitting grooves 82 formed on the outer side of said cam 81 are fitted to the guide members 80 (see FIG. 13). The upper surface of this cam 81 is made horizontal and, so as to keep lower the filling nozzles 11 for a certain distance, the under surface of the cam in the middle portion is lowered, the same as for the above-mentioned cam 76. The filling nozzles 11 urged upward with springs (not shown) are moved vertically by bringing the rollers 75 of the arms 74 into contact with the under surface of the cam 81. The rollers 83 pivoted to the tank 10 are moved along the upper surface of the cam 81.

Accordingly, by urging the filling nozzles 11 upward, the cam 81 is held at a certain height, in addition, when the conveyor table 7' and the filling nozzles 11 are rotated together, the cam 81 is not rotated since the fitting grooves 82 are in engagement with the guiding members 80. Therefore, the rollers 75 and 83 are moved on the under and top surfaces of the cam 81, respectively. As the result, the rollers 75 and the filling nozzles 11 having said rollers are lowered for a predetermined distance by the lowered portion of the cam 81, and in both end portions of the cam 81, the filling nozzles 11 rotating with the conveyor table 7' are raised to the upper positions by the spring force. When the tank 10 is moved down, the cam 81 is lowered with the tank 10 as it is held with the rollers 75 and 83.

Figure 15:
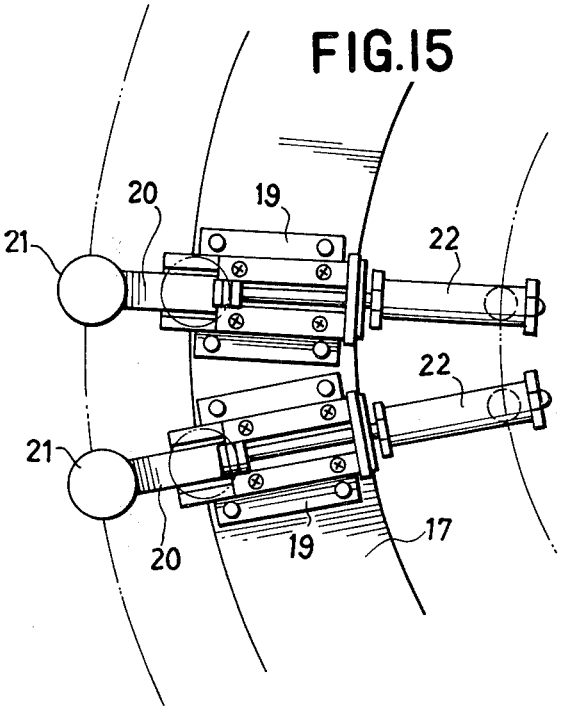
FIG. 15 is a schematic plan view taken along the line XV—XV in FIG. 14.

In this third embodiment, it is necessary to move the washing liquid pipes 21 according to the vertical movements of the filling nozzles 11, supporting posts 85 corresponding to the foregoing supporting posts 18 and of the same number as that of the filling nozzles 11 are circularly disposed, and said posts 85 are perpendicularly fitted to the through holes formed on the disk 3. As shown in FIG. 15, each bracket 19 on the supporting plate 17 attached to the upper end of each supporting post 85 is provided with a washing liquid pipe 21. In like manner as the first embodiment, when the bottles B are filled with a liquid, the washing liquid pipes 21 are retracted by the cylinder device 22 so as not to interrupt the movement of the bottles B. Further in the washing step, the washing liquid pipes 21 are moved forward to the positions just below the respective filling nozzles 11. Furthermore, the lower ends of said posts 85 are provided with rollers 86 and the rollers 86 move on the upper surface of a circular cam 87. In order to make the distances between the filling nozzles 11 and the washing liquid pipes 21 identical, this cam 87 moves the washing liquid pipes 21 vertically in compliance with the movements of the filling nozzles 11 caused by the other cam 81.

Accordingly, when the bottles B are filled, the washing liquid pipes 21 retracted away from the passage of bottles B move round together with the filling nozzles 11 and the conveyor table 7'. In addition, the distances between the filling nozzles 11 and the washing liquid pipes 21 are made the same by moving said pipes 21 in accordance with the filling nozzles 11. Thus when the filling machine is washed, the washing liquid pipes 21 are firstly moved to the positions just below the filling nozzles 11 and the tank 10 is let down to lower the cam 81 with the rollers 83. Thereby the filling nozzles 11 some of which are pushed down by the under surface of the cam 81, are lowered and approach the washing liquid pipes 21 with the same distances. Accordingly, each filling nozzle 11 and washing liquid pipe 21 are put together with the same force. Thus the valves within the filling nozzles 11 are simultaneously opened by the tip ends of the washing liquid pipes 21, and the filling liquid passages in the filling nozzles 11 and other parts can be thereby washed by supplying washing liquid from the washing liquid pipes 21.

Figure 16:
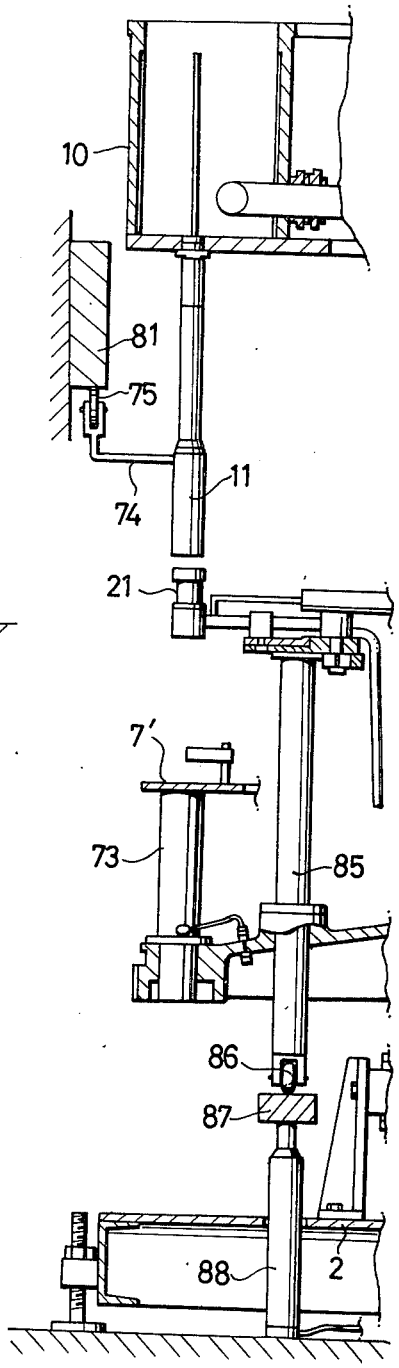
FIG. 16 and FIG. 17 are vertical sectional views of the main portions of modifications of the third embodiment.

FIG. 16 shows a modification of the above third embodiment, in which modification the tank 10 is not moved down but the cam 87 carrying the washing liquid pipes 21 is raised in order to open the valves in the filling nozzles 11 with the washing liquid pipes 21.

As shown in FIG. 16, the under surface of the cam 87 carrying the washing liquid pipes 21 is supported by a plurality of cylinder devices 88 which are vertically fixed to the base plate 2 or on the ground, while the cam 81 carrying the filling nozzles 11 is fixed to some support placed outside of the tank 10. Accordingly, when the filling nozzles 11 and conveyor table 7' are rotated together, the above-mentioned cam 87 is not rotated since it is fixed to the cylinder devices 88 and thus the washing liquid pipes 21 are vertically moved in accordance with the filling nozzles 11. Further in the washing step, when the cam 87 is raised by the cylinders 88, all of the tip ends of the washing liquid pipes 21 are simultaneously pushed against the end portions of the filling nozzles 11, thereby the same function as the foregoing embodiments can be obtained.

Figure 17:
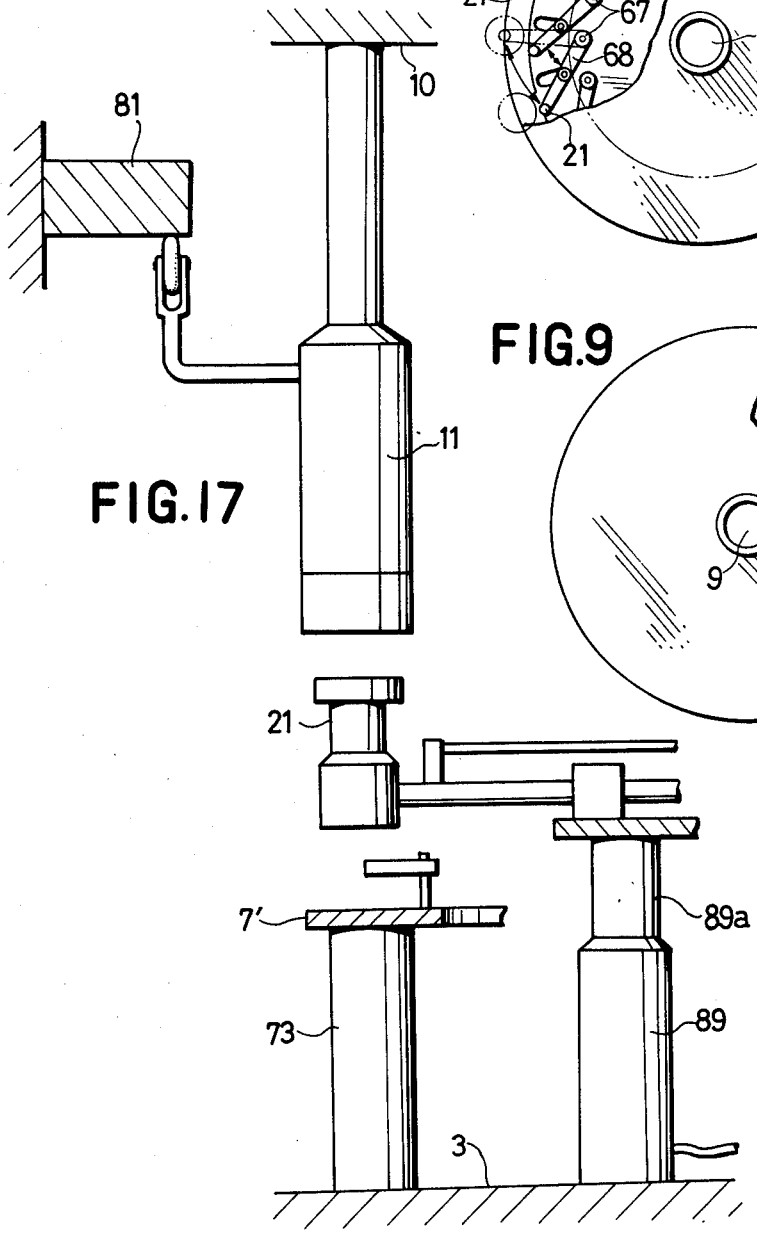

FIG. 17 shows the other modification of the third embodiment of the present invention, in which the cylinder devices 89 of the same number as that of the supporting plates 17 are mounted on the disk 3 and the supporting plates 17 are attached on the cylinder rods 89*a* of the cylinder devices 89. In this modified embodiment, it is not necessary to move the washing liquid pipes 21 on the supporting plates 17 in accordance with the movement of the filling nozzles 11. In the usual filling step, the washing liquid pipes 21 may be retracted so as not to interrupt the passage of the bottles B and, in the washing step, the washing liquid pipes 21 which are not on the same horizontal level are moved to the positions just under the filling nozzles 11 and thereafter the washing liquid nozzles 21 are raised by supplying hydraulic pressure to each cylinder devices 89 from a single pressure source. Since the positions of the filling nozzles 11 are not on the same horizontal level by the function of the cam 81, some washing liquid pipes 21 are soon pushed to the filling nozzles 11 and the movements of the pipes 21 are stopped, however, other pipes 21 are further moved up until they are brought into contact with the respective filling nozzles 11. When all the washing liquid pipes 21 are pushed against the respective filling nozzles 11, the upward movements of all the pipes 21 are stopped and thus the pressure of the fluid supplied to the cylinder devices 89 is raised, therefore the washing liquid pipes 21 are further pressed against the filling nozzles with a higher pressure, accordingly the valves in the filling nozzles 11 are simultaneously opened. As will be understood from the above disclosures on the modification of the above, the washing liquid pipes 21 are not moved in accordance with the movement of the filling nozzles 11 in the liquid filling step, however, in the washing step, the heights of the washing liquid pipes 21 are arranged automatically with the following nozzles 11 which are not aligned on the same level.

Furthermore as the fourth embodiment, the filling machine is considered in which the relative vertical displacement among the filling nozzles is not caused but the relative vertical displacement among the washing liquid pipes are caused to occur. This type of the machine can be formed, needless to show with drawings, by combining the fixed type filling nozzles as shown in FIGS. 1 and 2 with the independently movable mechanisms of the washing liquid pipes as shown in FIG. 17.

Lastly, it should be emphasized that the specific embodiments described and shown herein are intended as merely illustrative and in no way restrictive of the invention.

What is claimed is:

1. In a machine for filling liquid into containers, comprising a rotatable support mounted for rotation around a vertical axis; a plurality of tables mounted in a circular array on said support for rotation therewith so that said tables move through a circular path, said tables being adapted to support containers; a plurality of downwardly extending filler nozzles, each nozzle being disposed in vertical alignment with one of said tables and being spaced vertically upwardly therefrom, means supporting said filler nozzles for rotation around said vertical axis conjointly with said tables so that said filler nozzles move through said circular path, said filler nozzles having normally closed valves therein which valves are adapted to be opened when containers supported on said tables are brought into contact with said nozzles; and means for effecting relative vertical movement between said tables and said filler nozzles as said tables and said nozzles move through said circular path so that during a portion of the conjoint movement of said tables and said nozzles through said circular path the containers supported on said tables are disposed in positions adjacent said nozzles whereby the valves in said nozzles are opened and said containers are filled with liquid and in the remainder of said circular path the containers are vertically spaced downwardly from said nozzles and the valves in said nozzles are closed, the improvement which comprises: a plurality of upwardly opening washing liquid pipes arranged in a circular array with there being one washing liquid pipe for each one of said filler nozzles, said washing liquid pipes being mounted for cojoint rotation around said vertical axis with said filler nozzles and said tables; means for supplying washing liquid to said washing liquid pipes; means for moving said washing liquid pipes between a first position wherein said washing liquid pipes are disposed out of vertical alignment with said filler nozzles and said tables so as not to interfere with movement of said filler nozzles and said tables, and a second position wherein each of said washing liquid pipes is disposed in vertical alignment with and is disposed between a filler nozzle and its associated table; and means for effecting relative vertical movement between said filler nozzles and said washing liquid pipes when said washing liquid pipes are in said second position to contact said washing liquid pipes against said nozzles whereby to open said valves and direct washing liquid upwardly into said filler nozzles.

2. A machine as claimed in claim 1 in which, said filler nozzles are mounted on a common horizontal level and are held against relative vertical movement, said tables are mounted for vertical movement and said means for effecting relative vertical movement between said tables and said filler nozzles comprises means for moving said tables vertically toward and away from said filler nozzles, and wherein said washing liquid pipes are mounted on a common horizontal level.

3. A machine as claimed in claim 2, in which said means for supporting said filler nozzles comprises a liquid tank mounted for rotation around said vertical axis, said filler nozzles being mounted on the underside of said liquid tank and extending downwardly therefrom, and said means for effecting relative vertical movement between said filler nozzles and said washing liquid pipes comprises means for moving said liquid tank vertically.

4. A machine as claimed in claim 2, including vertically movable support means supporting said washing liquid pipes, and said means for effecting relative vertical movement between said filler nozzles and said washing liquid pipes comprises means for vertically moving said vertically movable support means.

5. A machine as claimed in claim 2 including means supporting said washing liquid pipes for radial movement between said first and second positions and fluid pressure operated cylinder means for moving said washing liquid pipes radially.

6. A machine as claimed in claim 2 including a support member carrying said washing liquid pipes, means mounting said support member for circumferential movement relative to said tables and said filler nozzles and means for effecting circumferential movement of said support member to move said washing liquid pipes between said first and second positions.

7. A machine as claimed in claim 2, including a plurality of arms each carrying a washing liquid pipe at its outer end and being pivotally mounted at its inner end to a support body that rotates conjointly with said filler nozzles and said table, cam followers mounted on the mid-portions of said arms, a support member mounted for circumferential movement relative to said support body, said support member having a plurality of radial cam grooves in which said cam followers are disposed, and means for effecting circumferential movement of said support member to move said washing liquid pipes between said first and second positions.

8. A machine as claimed in claim 2, including a plurality of slidable members each carrying a washing liquid pipe at its outer end and a cam follower at its inner end, a rotatable disk mounted for circumferential movement relative to said tables and nozzles, said disk having a plurality of arcuate cam grooves in which said cam followers are disposed, and means for effecting circumferential movement of said rotatable disk to move said washing liquid pipes between said first and second positions.

9. A machine as claimed in claim 1, in which, said tables are mounted in a fixed vertical position on said rotatable support, means supporting said filler nozzles for vertical movement toward and away from said tables, said means for effecting relative vertical movement between said filler nozzles and said tables comprises means for moving said filler nozzles toward and away from said tables, said washing liquid pipes are mounted on a common horizontal plane and wherein the lower ends of the filler nozzles are disposed on a common horizontal plane when said washing liquid pipes are positioned adjacent said nozzles.

10. A machine as claimed in claim 9 in which said means for supporting said filler nozzles comprises a liquid tank mounted for rotation around said vertical axis, said filler nozzles being mounted on the underside of said liquid tank and extending downwardly therefrom, said means for effecting relative vertical movement between said tables and said filler nozzles comprises a fixed cam encircling the tank and having a lower cam surface, a cam follower attached to each filler nozzle and engaging said cam surface, and said means for effecting relative vertical movement between said filler nozzles and said washing liquid pipes comprises means for moving said liquid tank vertically which also causes the lower ends of the filler nozzles to be disposed in a common horizontal plane.

11. A machine as claimed in claim 9 in which said means for supporting said filler nozzles comprises a liquid tank mounted for rotation around said vertical axis, said filler nozzles being mounted on the underside of said tank and extending downwardly therefrom, said means for effecting relative vertical movement between said tables and said filler nozzles comprises a vertically movable cam encircling the tank and having a lower cam surface, a cam follower attached to each filler nozzle and engaging said cam surface, said means for effecting relative vertical movement between said filler nozzles and said washing liquid pipes comprises means for moving said cam vertically upwardly to cause the lower ends of the filler nozzles to be disposed in a common horizontal plane and means to move said washing liquid pipes vertically upwardly.

12. A machine as claimed in claim 9 in which said filler nozzles are attached to fluid pressure operated cylinders for controlling the vertical position of said nozzles.

13. A machine as claimed in claim 9 including means supporting said washing liquid pipes for radial movement between said first and second positions and fluid pressure operated cylinder means for moving said washing liquid pipes radially.

14. A machine as claimed in claim 9 including a support member carrying said washing liquid pipes, means mounting said support member for circumferential movement relative to said tables and said filler nozzles and means for effecting circumferential movement of said support member to move said washing liquid pipes between said first and second positions.

15. A machine as claimed in claim 9, including a plurality of arms each carrying a washing liquid pipe at its outer end and being pivotally mounted at its inner end to a support body that rotates conjointly with said filler nozzles and said table, cam followers mounted on the mid-portions of said arms, a support member mounted for circumferential movement relative to said support body, said support member having a plurality of radial cam grooves in which said cam followers are disposed, and means for effecting circumferential movement of said support member to move said washing liquid pipes between said first and second positions.

16. A machine as claimed in claim 9, including a plurality of slidable members each carrying a washing liquid pipe at its outer end and a cam follower at its inner end, a rotatable disk mounted for circumferential movement relative to said tables and nozzles, said disk having a plurality of arcuate cam grooves in which said cam followers are disposed, and means for effecting circumferential movement of said rotatable disk to move said washing liquid pipes between said first and second positions.

17. A machine as claimed in claim 1, in which, said tables are mounted in a fixed vertical position on said rotatable support, means supporting said filler nozzles for vertical movement toward and away from said tables, said means for effecting relative vertical movement between said filler nozzles and said tables comprises means for moving said filler nozzles toward and away from said tables, and means for vertically moving said washing liquid pipes conjointly with the vertical movements of their associated filler nozzles so as to maintain a constant vertical spacing therebetween while the containers are being filled.

18. A machine as claimed in claim 17 in which said means for supporting said filler nozzles comprises a liquid tank mounted for rotation around said vertical axis, said filler nozzles being mounted on the underside of said tank and extending downwardly therefrom, said means for effecting relative vertical movement between said tables and said filler nozzles comprises a vertically movable first cam encircling the tank and having a lower cam surface and a cam follower attached to each filler nozzle and engaging said cam surface, a roller mounted on said tank and engaging the upper surface of said first cam, said means for vertically moving said washing liquid pipes conjointly with said filler nozzles comprises a fixed second cam, said means for effecting relative vertical movement between said filler nozzles and said washing liquid pipes comprises means for moving said tank vertically downwardly to cause the lower ends of the filler nozzles to be positioned adjacent their associated washing liquid pipes.

19. A machine as claimed in claim 17, wherein said means for vertically moving said washing liquid pipes conjointly with said filler nozzles comprises a cam, and said means for effecting relative vertical movement between said filler nozzles and said washing liquid pipes comprises means for moving said cam vertically.

20. A machine as claimed in claim 17 in which said filler nozzles are attached to fluid pressure operated cylinders for controlling the vertical position of said nozzles.

21. A machine as claimed in claim 17, in which said washing liquid pipes are attached to fluid pressure operated cylinders for controlling the vertical position of said washing liquid pipes.

22. A machine as claimed in claim 17 including means supporting said washing liquid pipes for radial movement between said first and second positions and fluid pressure operated cylinder means for moving said washing liquid pipes radially.

23. A machine as claimed in claim 1, in which, and said means for effecting relative vertical movement between said filler nozzles and said washing liquid pipes comprises means for independently vertically moving said washing liquid pipes upwardly to position said washing liquid pipes adjacent said nozzles.

24. A machine as claimed in claim 23 wherein said means for independently vertically moving said washing liquid pipes upwardly comprises separate fluid pressure operated cylinders connected to said washing liquid pipes.

* * * * *